United States Patent [19]

Cooks et al.

[11] Patent Number: 4,791,292

[45] Date of Patent: Dec. 13, 1988

[54] CAPILLARY MEMBRANE INTERFACE FOR A MASS SPECTROMETER

[75] Inventors: Robert G. Cooks; Mark E. Bier; Jennifer S. Brodbelt, all of West Lafayette, Ind.; James C. Tou; Lemoyne B. Westover, both of Midland, Mich.

[73] Assignee: The Dow Chemical Company, Midland, Mich.

[21] Appl. No.: 855,894

[22] Filed: Apr. 24, 1986

[51] Int. Cl.[4] ..... H01J 41/04

[52] U.S. Cl. ..... 250/288; 250/304; 55/158

[58] Field of Search ..... 250/288, 288 A, 435, 250/304; 55/158

[56] References Cited

U.S. PATENT DOCUMENTS

| | | | |
|---|---|---|---|
| Re. 26,392 | 5/1968 | Craig et al. | 250/41.9 |
| 3,176,128 | 3/1965 | Ehrhardt et al. | 250/41.9 |
| 3,398,505 | 8/1968 | Llewellyn | 55/16 |
| 3,429,105 | 2/1969 | Llewellyn et al. | 55/158 |
| 3,449,563 | 6/1969 | Brown | 250/41.9 |
| 3,479,798 | 11/1969 | Ryhage | 55/158 |
| 3,590,243 | 6/1971 | Perrin et al. | 250/288 |
| 3,633,027 | 1/1972 | Ryhage | 250/288 |
| 3,638,401 | 2/1972 | Kabler | 55/158 |
| 3,649,199 | 3/1972 | Littlejohn | 250/288 |
| 3,662,520 | 5/1972 | Saunders | 55/158 |
| 3,673,405 | 6/1972 | Moorman et al. | 250/288 |
| 3,712,111 | 1/1973 | Llewellyn | 250/41.9 |
| 3,828,527 | 8/1974 | Briggs et al. | 55/158 |
| 3,867,631 | 2/1975 | Briggs et al. | 250/288 |
| 3,926,561 | 12/1975 | Lucero | 55/158 |
| 3,997,298 | 12/1976 | McLafferty, et al. | 250/288 A |
| 4,008,388 | 2/1977 | McLafferty et al. | 250/288 |
| 4,267,457 | 5/1981 | Nakagawa et al. | 250/288 |
| 4,298,795 | 11/1981 | Takeuchi et al. | 250/288 A |
| 4,383,171 | 5/1983 | Sinha, et al. | 250/288 |
| 4,403,147 | 9/1983 | Melera et al. | 250/288 A |
| 4,439,679 | 3/1984 | McIlroy et al. | 250/288 |
| 4,448,691 | 5/1984 | Davis | 422/70 |
| 4,454,894 | 6/1984 | Tallon | 250/288 |

OTHER PUBLICATIONS

Weaver et al., *Biochimica et Biophysica Acta,* 438, (1976), 296–303.

Westover et al., *Analytical Chemistry,* vol. 46, No. 4, Apr. 1974, 568–571.

*Primary Examiner*—Bruce C. Anderson

*Assistant Examiner*—Jack I. Berman

[57] ABSTRACT

A device for introducing a sample into a mass spectrometer which generally comprises a probe which is connected to the mass spectrometer and a semipermeable capillary tube connected at the end of the probe. The probe includes conduit passageways for permitting bidirectional fluid flow through the probe, and the capillary tube is connected to the end of the probe so as to permit the flow of a fluid containing the sample to be analyzed through the probe and the capillary tube. This fluid flow through the capillary tube will enable at least a portion of the sample to be transferred into the mass spectrometer via diffusion through the capillary tube.

18 Claims, 2 Drawing Sheets

CAPILLARY MEMBRANE INTERFACE FOR A MASS SPECTROMETER

BACKGROUND OF THE INVENTION

The present invention relates generally to mass spectrometers, and particularly to a device and method for introducing a sample into a mass spectrometer which employs a semipermeable capillary tube.

The selected introduction of components of a fluid into a mass spectrometer has been a long standing problem. One approach to solving this problem has been the use of various types of molecular separators including membrane separators. The use of membrane separators is particularly advantageous when it is desired to monitor organics in an aqueous medium. These membrane separators have permitted trace solution analysis, gas analysis, and in vivo studies for low molecular weight organic molecules. They have also been applied to reaction monitoring, including the indirect analysis of particular components through secondary product formulation. The following publications and patents are exemplary of the state of the art in this field: "Novel Mass Spectromatric Sampling Device-Hollow Fiber Probe", by L. B. Westover, J. C. Tou, and J. H. Mark, Analytical Chemistry (1974), Volume 46, page 568; "Biochemical Assay By Immobilized Enzymes And A Mass Spectrometer", by J. C. Weaver, M. K. Mason, J. A. Jarrell, and J. W. Peterson, Biochimica et Biophysica Acta, (1976), Volume 438, page 296; "Mass Spectrometer Polymer Membrane Sample Introduction Device", by G. J. Kallos and N. H. Mahle, Analytical Chemistry (1983), Volume 55, page 813; Llewellyn, et al U.S. Pat. No. 3,429,105, issued on Feb. 25, 1969; Lucero U.S. Pat. No. 3,926,561, issued on Dec. 16, 1985; Kabler U.S. Pat. No. 3,638,401, issued on Feb. 1, 1972; Littlejohn U.S. Pat. No. 3,649,199, issued on Mar. 14, 1972; and Saunders U.S. Pat. No. 3,662,520, issued on Mar. 16, 1972.

In general, these prior membrane interfaces have been positioned exterior to the ion source of the mass spectrometer. This can cause condensation along the transfer lines which can result in poor response times, memory effects and analyte dilution for these otherwise useful configurations. In addition to the problems caused by the distance for which the analyte must travel to reach the ion source of the mass spectrometer, room temperature interfaces often give poor response times and memory effects due to the effect of lower permeation rates with temperature. Other shortcomings of the prior art include the reliance on relatively large sample volumes and the lack of the provision for the removal of excess or waste solution.

Accordingly, it is a principal objective of the present invention to provide a novel device for introducing a sample into a mass spectrometer which employs a semipermeable capillary membrane.

It is a more specific objective of the present invention to provide a mass spectrometer interface which employs a semipermeable capillary tube through which a fluid containing the sample to be analyzed is permitted to flow.

It is another objective of the present invention to provide a capillary membrane interface to a mass spectrometer which can be directly disposed in the ion source of the mass spectrometer.

It is a further objective of the present invention to provide a direct insertion membrane probe (DIMP) for the selective introduction of organic molecules from an aqueous solution into a mass spectrometer.

It is an additional objective of the present invention to provide a direct insertion membrane probe which does not require large sample volumes and also permits recycling of the aqueous solution through the capillary membrane.

It is yet a further objective of the present invention to provide a direct insertion membrane probe which can be used with a variety of mass spectrometers, including tandem mass spectrometers.

It is yet another objective of the present invention to provide a direct insertion membrane probe which is heated to enhance the analyte permeation rate and decrease any memory effects in the capillary membrane.

It is still an additional objective of the present invention to provide a direct insertion membrane probe which may be used to monitor samples from a reaction process.

It is still a further objective of the present invention to provide a direct insertion membrane probe which is economical to manufacture and which displays high sensitivity, especially for components in aqueous solutions.

SUMMARY OF THE INVENTION

To achieve the foregoing objectives of the present invention, a device is provided for introducing a sample into a mass spectrometer which generally comprises a probe which is connected to the mass spectrometer and a semipermeable capillary tube connected at the end of the probe. The probe includes conduit passageways for permitting bidirectional fluid flow through the probe, and the capillary tube is connected to the end of the probe so as to permit the flow of a fluid containing the sample to be analyzed through the probe and the capillary tube. This fluid flow through the capillary tube will enable at least a small fraction of the sample to be transferred into the mass spectrometer via diffusion through the capillary tube.

In one form of the present invention, the probe is preferably connected to the mass spectrometer such that the capillary tube is disposed in the ion source of the mass spectrometer. This close proximity between the capillary tube and the ionization region of the mass spectrometer enables the high temperature of the ion source to enhance the analyte permeation rate and thus decrease the memory effects of the capillary tube. While this configuration takes advantage of the heat transfer from the ion source, other suitable sources of heat may also be utilized.

Additional advantages and features of the present invention will become apparent from a reading of the detailed description of the preferred embodiments which make reference to the following set of drawings.

DETAILED DESCRIPTION OF THE PREFERRED EMBODIMENTS

Figure 1:
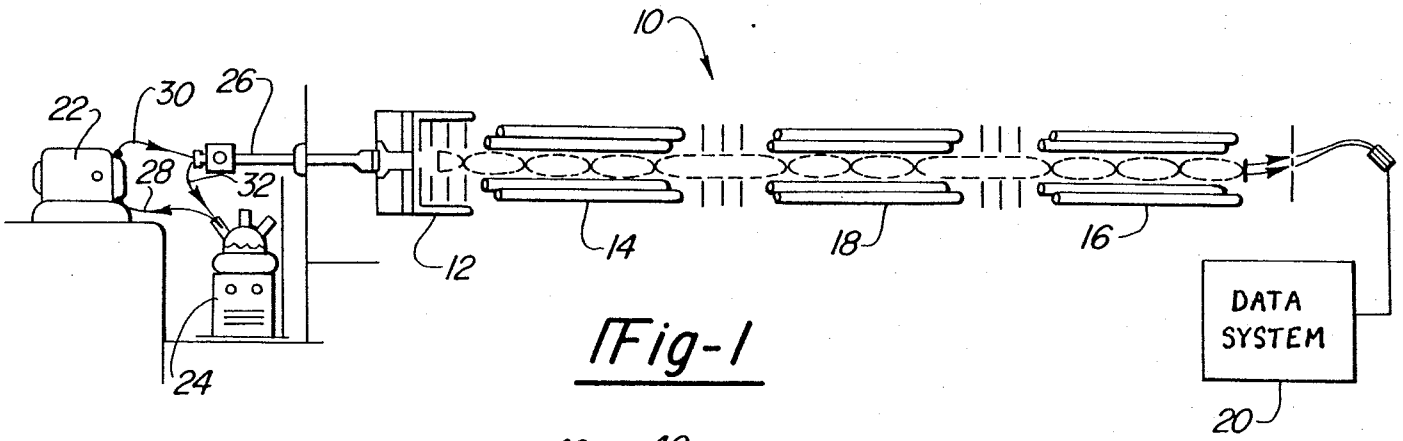
FIG. 1 is a diagrammatic view of a mass spectrometer employing one embodiment of a membrane interface device according to the present invention.

Referring to FIG. 1, a diagrammatic view of a mass spectrometer 10 utilizing a capillary membrane interface device according to the present invention is shown. The mass spectrometer 10 is shown to be a triple quadrupole mass spectrometer having an ion source generally designated by the reference numeral 12. The quadrupoles 14 and 16 are used for mass separation, and the quadrupole 18 is used for collision and focusing. In one embodiment according to the present invention, the mass spectrometer 10 is a Finnigan MAT 4500 triple quadrupole mass spectrometer equipped with an Incos Data System 20. However, it should be appreciated that this mass spectrometer is identified for exemplary purposes only, and that the principles of the present invention are equally applicable to many other mass spectrometers. Thus, for example, the ion source may be based upon either electron impact or chemical ionization. A Milton Roy mini-pump 22 is used to cause fluid flow from a reaction vessel or sample reservoir 24 through a membrane interface device 26 according to the present invention. As shown by the conduits 28, 30 and 32, this arrangement allows for the fluid containing the analyte or sample to be analyzed by the mass spectrometer 10 to be recycled through the probe 26, if desired.

Figure 2:
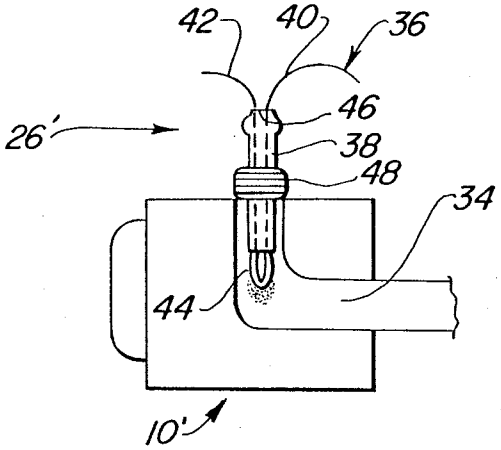
FIG. 2 is another diagrammatic view of the mass spectrometer interface which particularly illustrates a membrane interface device according to the present invention.

FIG. 2 shows a membrane interface device 26' which generally corresponds to the device 26 shown in FIG. 1. The device 26' is connected to the mass spectrometer 10' such that one end of the device 26' extends into the high vacuum region 34 of the mass spectrometer 10'. This high vacuum region leads to the ion source which will ionize the sample to be analyzed by the mass spectrometer.

The device 26' represents an early form of construction which generally comprises a length of semipermeable capillary tubing 36 which has been fashioned into the form of a loop and disposed in a stainless steel tube 38. The inlet and outlet legs 40–42 of the tubing 36 remain exposed to the atmosphere, while the U-shaped loop 44 of the tubing is contained within the high vacuum region 34 of the mass spectrometer 10'. The capillary tube 36 is sealed with a vacuum epoxy cement at the exposed end 46 of the stainless steel tube 38 to provide a fluid tight seal between the atmosphere and the high vacuum region 34 of the mass spectrometer 10'. A threaded joint is generally indicated at the reference numeral 48 for connecting the device 26' to the mass spectrometer 10'. A Viton o-ring is also preferably interposed between the device 26' and the mass spectrometer 10' at the threaded joint 48 to ensure a vacuum seal. A further description of this arrangement, as well as a discussion of experiments conducted using this arrangement, may be found in "An Exceedingly Simple Mass Spectrometer Interface With Application To Reaction Monitoring And Environmental Analysis", by J. S. Brodbelt and R. G. Cooks, Analytical Chemistry (1985), Volume 57, page 1153. This publication is hereby incorporated by reference.

In accordance with the method of operation for the invention, a pump, syringe or other suitable conveying means is used to cause the flow of a fluid containing a sample to be analyzed into the inlet leg 40 of the capillary tube 36. This fluid flows down the inlet leg 40 of the capillary tube 36, through the U-shaped loop portion 44 of the capillary tube, and back up through the capillary tube and out of the outlet leg 42 of the capillary tube. This fluid flow may be continuous or discontinuous as may be appropriate for the sample being analyzed. Particularly with respect to the U-shaped loop portion 44 of the capillary tube 36, the sample or analyte will permeate or diffuse through the tubing to facilitate its introduction into the high vacuum region 34 of the mass spectrometer 10'.

Various fluids may be used to transport the sample to be analyzed through the capillary tubing 36. For example, in an environmental monitoring process, water from an industrial waste stream may be used as the fluid which contains one or more toxicants to be analyzed. Examples of compounds which may be suitably introduced into and analyzed by the mass spectrometer include naphthalene, aromatic hydrocarbons, chlorinated hydrocarbons, cyclohexanone, ketones, and ethers among others. It should also be noted that the membrane interface devices and probes according to the present invention may be used to function as a liquid chromatograph/mass spectrometer interface. In such an application, it may be advisable to provide for two membranes. Specifically, one of the membranes could act as a separator (based on size exclusion, diffusivity or other membrane properties), and the second membrane could act as the interface to the high vacuum region of the mass spectrometer.

Figure 3:
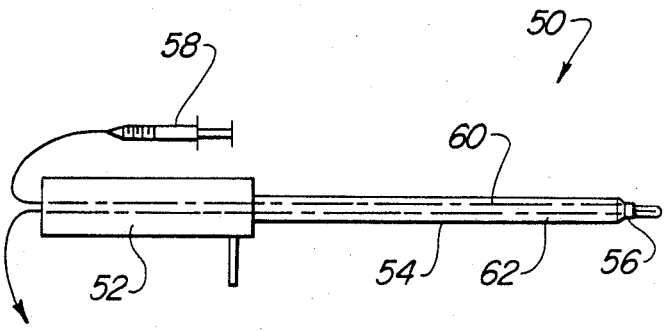
FIG. 3 is a side elevation view of a direct insertion membrane probe according to the present invention.

Referring to FIG. 3, a direct insertion membrane probe (DIMP) 50 according to the present invention is shown. The probe 50 generally comprises a handle portion 52, a barrel portion 54, and a tip portion 56. While the probe 50 is shown to be connected to a syringe 58, other suitable conveying means for providing a liquid sample flow through the probe may be provided in the appropriate application. The handle portion 52 and the barrel portion 54 of the probe 50 were adapted from a Finnigan MAT ion volume insertion/retraction tool. However, it should be understood that the principles of the present invention are not restricted to any one probe configuration, and that other suitable probe constructions may be employed in the appropriate applications.

Figure 4:
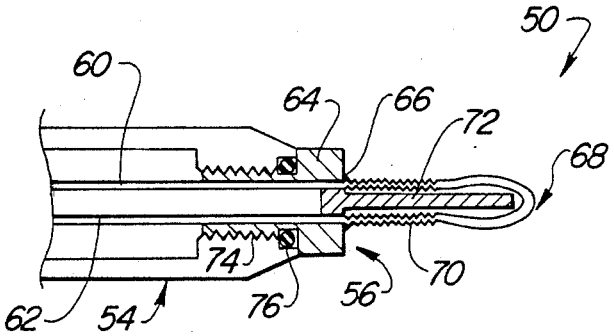
FIG. 4 is an enlarged cross sectional view of a portion of the direct insertion membrane probe shown in FIG. 3.

Referring to FIG. 4, an enlarged cross sectional view of the end section to the probe 50 is shown. In FIG. 4, the probe 50 is shown to include a pair of elongated conduits 60 and 62 which extend through the handle portion 52, the barrel portion 54, and the tip portion 56. In one form of the present invention, the conduits 60 and 62 comprise two 50 cm lengths of stainless steel microbore tubing (0.51 mm o.d.×0.13 mm i.d.). However, it should be appreciated that other suitable conduits could be employed, such as Teflon tubing, fused silica capillary tubing or glass lined stainless steel tubing.

The conduits 60 and 62 are preferably secured to the base 64 of the tip portion 56 by soldering the conduits to the base with silver solder generally at the reference numeral 66. This connection must be such as to provide a fluid tight seal between the conduits 60 and 62 and the base 64 of the tip portion 56. Importantly, the conduits 60 and 62 should be connected to the base 64 so as to provide a portion of these conduits which will extend beyond the base 64 (e.g., 1 cm) to facilitate the connection of a semipermeable capillary tube 68 to the conduits.

The capillary tube membrane 68 is connected to the conduits 60 and 62 by pushing each end of the tube over one of the conduits extending from the base 64 of the tip portion 56. A polyfilament thread or wire 70 is then coiled around each of the ends of the tubing 68 which have been pushed over the corresponding ends of the conduits 60 and 62 to secure the tubing to the conduits. An additional polyfilament thread may also be coiled around the entire assembly which comprises the tubing covered ends of the conduits 60 and 62 and a post 72 which extends from the base 64 of the tip portion 56. The post 72 is used to further stabilize the ends of the conduits 60 and 62 and the capillary tube 68. As an alternate method of connection, the tubing 68 could be cemented or epoxyed onto the ends of the conduits 60–62. As another alternate, the tubing 68 could be first swelled in a solvent, slipped over the ends of the conduits 60–62, and shrunk in place.

As shown in FIG. 4, the capillary tube 68 forms a generally U-shape path for the fluid being conveyed through the probe 50. However, it should be appreciated that other suitable configurations for a capillary membrane according to the present invention may be utilized in the appropriate application. For example, in order to increase the surface are of the capillary membrane, the capillary tube 68 could be coiled or wrapped around the post 72. In one form of the present invention, the capillary tube 68 comprises a dimethyl vinyl silicone polymer capillary tube (ASTM:VMQ, Dow Corning Corporation, Inc.). However, it should be appreciated that the type of material chosen for the capillary tube should be appropriate to the compounds or analytes which need to permeate or diffuse through the tube during operation.

The tip portion 56 is advantageously used to provide a demountably attached portion to the probe 50 which may be easily interchanged to provide a different or fresh capillary membrane. Accordingly, the tip portion 56 is machined or otherwise formed to provide a threaded section 74 which is used to mount the tip portion 56 to the barrel portion 54 of the probe 50. It should be appreciated that other suitable techniques for connecting the tip portion 56 to the barrel portion 54 may be employed in the appropriate application. A Viton o-ring 76 is also preferably interposed between the barrel portion 54 and the tip portion 56 to ensure an air tight seal between these portions of the probe 50.

Figure 5:
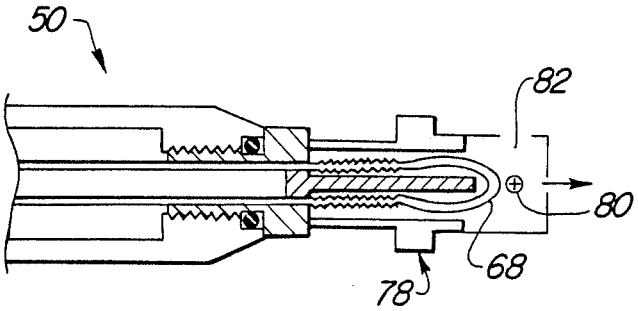
FIG. 5 is another cross sectional view of the direct insertion membrane probe of FIG. 4, which particularly illustrates its placement in the ion source of a mass spectrometer.

Referring to FIG. 5, an additional view of the probe 50 is shown as connected to the ion source 78 of a mass spectrometer. As shown in FIG. 5, the probe 50 is connected to the ionization chamber 78 such that the capillary tube 68 extends into the ionization chamber in close proximity (e.g., 1 mm) to the electron beam 80 which is used to ionize the sample. The analyte molecules permeated through the capillary tube membrane can also be ionized by the reactant ions generated from the reactant gas entering into the ionization chamber through orifice 82. One important advantage of this proximity between the ion source and the probe 50, is that heat from the ionization chamber will be transmitted through radiation and conductance via the connecting parts to the probe. Accordingly, the high temperature of the ion source may be utilized to enhance the analyte permeation rate through the capillary tube 68 and thus decrease the memory effects of this membrane. However, it should be appreciated that the probe 50 does not necessarily have to be disposed within the ionization chamber (e.g. in the high vacuum region as shown in FIG. 2), and that a separate source of heat may be provided which will permit independent control over the temperature of the probe.

Fluid flow through the probe 50 can be continuous for steady state conditions or segmented with a solvent (e.g., water) as in flow injection analysis (FIA). The fluid or solution carrying the sample to be analyzed enters the probe 50 through the inlet conduit 60 and flows down through this conduit to the capillary membrane 68. As the fluid flows through the capillary membrane 68 and back up through the exit conduit 62, the sample or analyte will permeate or diffuse through the walls of the tubing 68 and will be vaporized into the ionization chamber. In general, only a very small fraction of the analyte which passes through the tube 68 will be introduced to the ionization chamber 78 via diffusion. The major portion of the analyte will be removed as waste or collected as a sample fraction to be recycled or returned to a reaction vessel. Suitable valves or other similar control devices may be used to regulate the flow rate of the fluid through the probe 50. It should be appreciated from the above that the probe 50 has an extremely small internal volume (e.g., less than 50 $\mu$l) with a dead volume which is negligible.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

We claim:

1. A device for introducing a sample into a mass spectrometer, comprising:

probe means for removably connecting said device to a mass spectrometer such that a barrel portion of said probe means will extend into said mass spectrometer when said probe means is connected to said mass spectrometer, said probe means having conduit means for permitting bidirectional fluid flow through said probe means; and semipermeable tubing means connected to said conduit means of said probe means for permitting the flow of a fluid containing said sample down said probe means, through said tubing means and up said probe means such that at least a portion of said sample is transferred into said mass spectrometer through said tubing means.

2. The invention according to claim 1, wherein said tubing means is connected to said probe means so as to form a U-shaped loop.

3. The invention according to claim 1, wherein said conduit means of said probe means includes a pair of conduits extending from one end of said probe means for connecting said tubing means to said conduit means.

4. The invention according to claim 3, wherein the ends of said tubing means are fitted over the ends of said pair of conduits, and thread means is coiled around the ends of said tubing means which have been fitted over the ends of said pair of conduit means for securing said tubing means to said conduit means.

5. The invention according to claim 3, wherein said probe means includes a tip portion which is demountably secured to said barrel portion.

6. The invention according to claim 5, wherein said probe means includes seal means for providing a fluid tight seal between said barrel and tip portions of said probe means.

7. The invention according to claim 6, wherein said pair of conduits are secured to said tip portion and extend through said barrel portion of said probe means.

8. The invention according to claim 7, wherein one of said conduits provides a passageway for fluid flow to said tubing means, and the other of said conduits provides a passageway for fluid flow from said tubing means.

9. The invention according to claim 8, wherein said probe means includes a handle portion extending from said barrel portion for providing an interface between said pair of conduits and a means for conveying a fluid containing the sample to be analyzed to and from said pair of conduits.

10. The invention according to claim 1, wherein said tubing means comprises a capillary tube made of a silicone polymer.

11. The invention according to claim 10, wherein said capillary tube is made from a dimethyl vinyl silicone polymer.

12. The invention according to claim 5, wherein said tip portion includes a post which extends between the ends of said conduits to support said conduits and said tubing means.

13. In a mass spectrometer having an ion source for ionizing a sample to be analyzed by said mass spectrometer, a device for introducing a sample into the ion source of said mass spectrometer, comprising:

a probe removably connected to said mass spectrometer such that one end of said probe extends into the ionization chamber of said mass spectrometer, said probe having conduit means for permitting bidirectional fluid flow through said probe; and semipermeable capillary tubing means connected to said conduit means of said probe for permitting the flow of a fluid containing said sample through said probe such that at least a portion of said sample is transferred into the ionization chamber of said mass spectrometer through said tubing means.

14. The invention according to claim 13, wherein said tubing means is connected to said probe so as to form a U-shaped loop.

15. The invention according to claim 14, when the apex of said loop is disposed adjacent to the electron beam of said ionization chamber.

16. The invention according to claim 13, further including conveying means connected to said probe for causing the flow of said fluid containing said sample down through said conduit means of said probe, through said tubing means, and up through said conduit means.

17. The invention according to claim 16, wherein said conveying means recirculates said fluid through said conduit means of said probe and said tubing means.

18. A method of introducing a sample into a mass spectrometer, comprising the steps of:

causing the flow of a fluid containing said sample to be analyzed by said mass spectrometer;

directing the flow of said fluid down through a probe extending into said mass spectrometer;

providing a semipermeable tube at the end of said probe which will permit the flow of said fluid from said probe to pass through said tube and enable at least a portion of said sample to be transferred into said mass spectrometer by diffusion; and directing the flow of said fluid flow inside said tube back up said probe and out of said mass spectrometer

* * * * *